US009637987B2

(12) United States Patent
Kang et al.

(10) Patent No.: US 9,637,987 B2
(45) Date of Patent: May 2, 2017

(54) CORING SYSTEM INCLUDING TENSIOMETER AND METHOD OF DECIDING ACCURATE CORING USING THE SAME

(71) Applicant: KOREA INSTITUTE OF GEOSCIENCE AND MINERAL RESOURCES, Daejeon (KR)

(72) Inventors: Moo Hee Kang, Daejeon (KR); Gee Soo Kong, Daejeon (KR); Kyong O Kim, Daejeon (KR); Jin Ho Kim, Daejeon (KR); Young Ho Yoon, Daejeon (KR); Chang Sik Lee, Gyeonggi-do (KR); Kyu Jung Kim, Gyeonggi-do (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 589 days.

(21) Appl. No.: 14/254,274

(22) Filed: Apr. 16, 2014

(65) Prior Publication Data

US 2015/0136487 A1 May 21, 2015

(30) Foreign Application Priority Data

Nov. 15, 2013 (KR) ..... 10-2013-0138970

(51) Int. Cl.
*E21B 25/18* (2006.01)
*E21B 25/00* (2006.01)

(52) U.S. Cl.
CPC ..... *E21B 25/18* (2013.01); *E21B 25/005* (2013.01)

(58) Field of Classification Search
CPC .... E21B 41/00; E21B 43/0107; E21B 19/006; E21B 25/00; E21B 25/14; E21B 7/12; E21B 19/08; E21B 19/02; E21B 25/18; E21B 47/09; E21B 7/124; G01L 5/04; G01L 5/06
USPC ..... 175/5, 58, 244
See application file for complete search history.

(56) References Cited

U.S. PATENT DOCUMENTS 3,299,969 A * 1/1967 Inderbitzen ..... E21B 7/124 175/245
3,301,336 A * 1/1967 Mount ..... E21B 7/1245 175/135
3,874,462 A * 4/1975 Harms ..... E21B 25/18 175/220
3,875,796 A * 4/1975 Gilliard ..... E21B 25/18 175/20
4,143,720 A * 3/1979 Verdin ..... E21B 19/002 175/5

(Continued)

FOREIGN PATENT DOCUMENTS

JP 2007-262734 10/2007
JP 2010-054393 3/2010

(Continued)

*Primary Examiner* — Michael Wills, III
(74) *Attorney, Agent, or Firm* — Cesari and McKenna LLP

(57) ABSTRACT

The present invention relates to a coring system and a determining method that can determine whether accurate coring was achieved. A coring system according to the present invention includes: a coring part with a core to be filled with an object to be cored; a driving unit controlling upward/downward movement of the coring part; a rope connecting the coring part with the driving unit; and a tensiometer measuring tension in the rope.

10 Claims, 7 Drawing Sheets

(56) References Cited

U.S. PATENT DOCUMENTS

| | | | | | |
|---|---|---|---|---|---|
| 4,171,640 | A * | 10/1979 | van Mastrigt | G01L 5/107 | 73/862.451 |
| 5,249,472 | A * | 10/1993 | Brown | G01L 5/06 | 73/862.472 |
| 5,351,531 | A * | 10/1994 | Kerr | E21B 47/04 | 324/206 |
| 6,850,463 | B2 | 2/2005 | Winnacker | | |
| 6,976,385 | B2 | 12/2005 | Okada et al. | | |
| 2002/0105858 | A1 | 8/2002 | Winnacker | | |
| 2004/0253806 | A1 | 12/2004 | Steinlesberger et al. | | |
| 2012/0145457 | A1* | 6/2012 | Stockton | E21B 25/00 | 175/44 |

FOREIGN PATENT DOCUMENTS

| | | |
|---|---|---|
| JP | 2010-203147 | 9/2010 |
| JP | 2012-137318 | 7/2012 |
| KR | 10-20070005558 | 4/2007 |
| KR | 10-20110001863 | 7/2012 |

* cited by examiner

CORING SYSTEM INCLUDING TENSIOMETER AND METHOD OF DECIDING ACCURATE CORING USING THE SAME

CROSS-REFERENCE TO RELATED APPLICATION

The application claims the benefit of Korean Patent Application No. 10-2013-0138970 filed on Nov. 15, 2013 and the entire contents of which are incorporated herein by reference.

BACKGROUND

1. Field of the Disclosure

The present invention relates to a coring system including a tensiometer and a method of determining accurate boring using the same.

2. Description of the Related Art

There have been developed many coring rigs for studying underground resources or observing the history and the environmental change of the earth.

Most coring rigs place a coring part with a core for carrying an object to be cored, on the bottom of the sea or the bottom of a river and then insert it into a sediment, using the gravity etc. When the coring part is inserted in the sediment, some of the sediment comes into the core, and a sample of the sediment is obtained by returning the coring part.

However, because the coring part is inserted deep in the bottom of the sea or the bottom of a river in most cases of coring, there is a problem in that it is difficult to know whether the coring part is inserted in a sediment while keeping vertical.

When a coring part is not vertically inserted in a sediment, there is a problem in that the position (depth) of the expected sample in the sediment and the position (depth) of the actually obtained sample in the sediment become different.

FIG. 1 shows a case when a coring part is accurately inserted in a sediment while keeping vertical and FIG. 2 shows a case when a coring part is inaccurately inserted at a angle in the bottom of the sea.

The same amount of samples of the sediment remains in the cores of the coring parts in both of FIGS. 1 and 2. In those cases, however, the positions (depths) of the samples in the sediments are different and it causes an error in investigation of changes in composition to the depth of the sediment.

PRIOR ART DOCUMENT

Patent Document

U.S. Pat. No. 6,850,463 (Published on Feb. 1, 2005)
U.S. Pat. No. 6,946,386 (published on Dec. 20, 2005)

SUMMARY

The present invention has been made in an effort to provide a coring system and a method that can accurately determine whether coring was accurately performed.

An aspect of the present invention provides a coring system including: a coring part with a core to be filled with an object to be cored; a driving unit controlling upward/downward movement of the coring part; a rope connecting the coring part with the driving unit; and a tensiometer measuring tension in the rope.

The coring system may further include a determining unit that determines whether accurate coring was achieved by the coring part on the basis of a measurement result by the tensiometer.

The determining unit may determine that accurate coring was achieved, when tension in returning of the coring part is a predetermined value or more.

The determining unit may determine whether accurate coring was achieved, by comparing the tension when the coring part is returned with the tension before/after the returning.

The determining unit may determine that accurate coring was achieved, when the tension in returning of the coring part is large by a predetermined level than the tension before/after the returning.

The coring system may further include a display unit that displays the measurement value by the tensiometer.

The coring system may further include coring pulleys disposed between the driving unit and the coring part and changing the arrangement direction of the rope to be vertical, in which the tensiometer measures tension in the rope, between the coring pulleys and the driving unit.

The coring system may further include a tension pulley between the tensiometer and the rope.

Another aspect of the present invention provides a method that determines whether accurate coring was achieved, in a coring system including: a coring part with a core to be filled with an object to be cored; a driving unit controlling upward/downward movement of the coring part; and a rope connecting the coring part with the driving unit. The method may include: measuring tension in the rope in coring; and determining whether coring was accurately performed by the coring part on the basis of the measurement result by the tensiometer.

The determining may include comparing the tension when the coring part is returned with the tension before/after coring.

The determining may further include determining that accurate coring was achieved, when the tension in returning of the coring part is larger by a predetermined level than the tension before/after coring.

The coring system may further include coring pulleys disposed between the driving unit and the coring part and changing the arrangement direction of the rope to be vertical, in which the measuring of tension may be to measure tension in the rope, between the coring pulleys and the driving unit.

The present invention provides a coring system and a determining method that can determine whether accurate coring was achieved.

DETAILED DESCRIPTION OF THE EMBODIMENT

Hereinafter, the present invention will be described in detail with reference to the accompanying drawings.

The accompanying drawings are only examples for illustrating the spirit of the present invention in detail and the scope of the present invention is not limited thereto.

Although a type of coring part using a weight is exemplified in the following description, the coring part of the present invention may be used for a type using a piston or a box type of coring.

Further, although it is exemplified in the following description to core a sediment on the bottom of the sea, the present invention may be used for coring a sediment or other objects on the bottom of a river.

Figure 4:
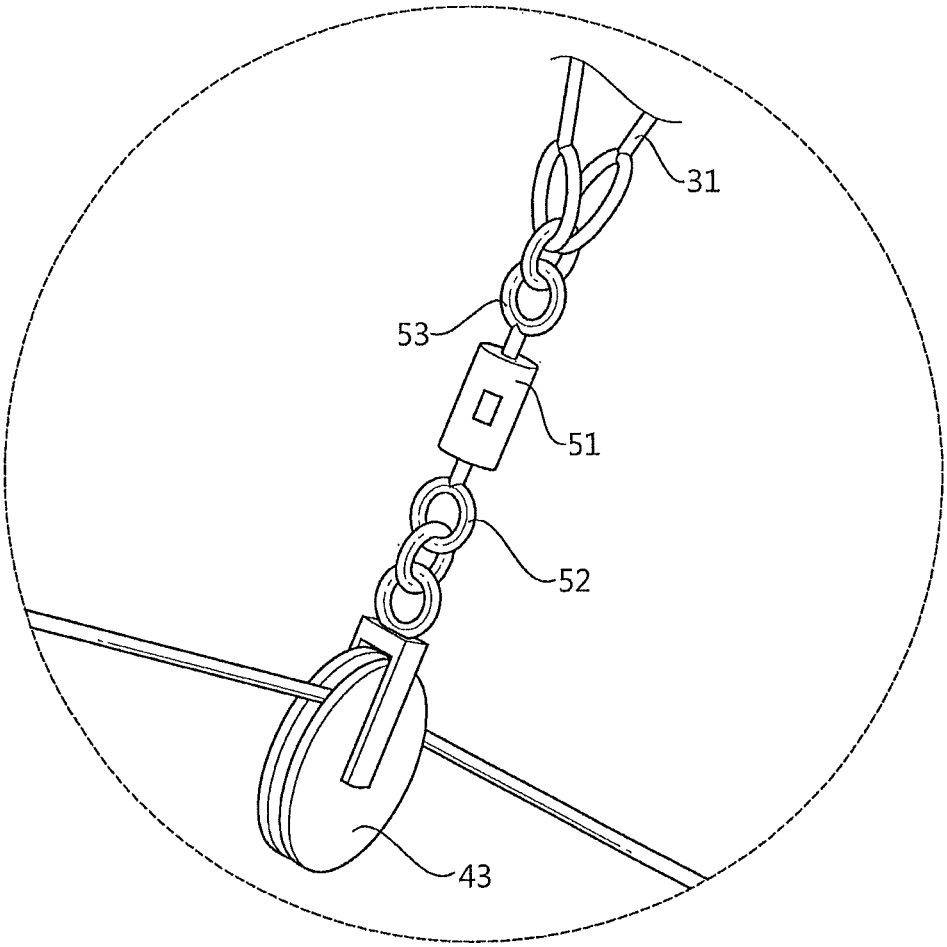
FIG. 4 is an enlarged view of the portion A of FIG. 3.
Figure 5:
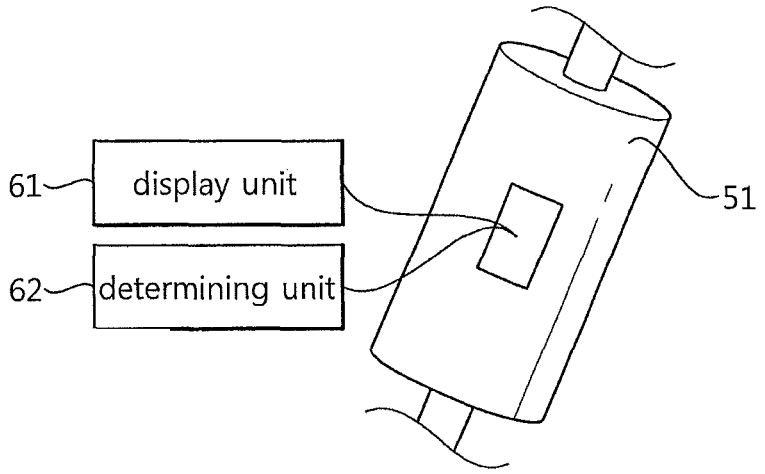
FIG. 5 is a view showing the flow of measurement data of a tensiometer according to an embodiment of the present invention.

A coring system according to an embodiment of the present invention is described with reference to FIGS. 3 to 5.

A coring system 1 includes a coring part 10, a driving unit 20, a rope 30, and a tensiometer 51.

The coring part 10 and the driving unit 20 are connected through a rope 30 and the coring part 10 is moved up/down by operation of the driving unit 20. The tensiometer 51 measures tension of the rope 30.

The coring part 10 is composed of a weight and a coring rod 12 and a coring core 13 that is an empty space in which a sediment can be picked is formed in the coring rod 12. The top of the weight 11 is connected to the rope 30 and the coring part 10 is moved up/down by operation of the driving unit 20.

As the rope 30 is loosened after the coring part 10 is placed on the bottom of the sea, the coring rod 12 is inserted into a sediment by the weight of the weight 11. A sample of the sediment is picked into the coring core 13 in the insertion.

The driving unit 20 may be implemented by an electric motor etc. and moves up/down the coring part 10. When coring is controlled on a ship, the driving unit 20 is disposed on the ship. In detail, the driving unit 20 may be an electric winch.

The rope 30 connects the driving unit 20 with the coring part 10 and transmits the power from the driving unit 20 to the coring part 10. The rope 30 may be any one as long as it is made of a material suitable for power transmission. For example, a natural substance rope, a synthetic resin rope, a metal wire, or a chain may be used.

The extension direction of the rope 30 is changed by two pulleys 41 and 42. The extension direction of the rope 30 is changed vertically in the direction of gravity on the coring part 10 by the first pulley 41 and is changed too between the driving unit 20 and the first pulley 41 by the second pulley 42. The first pulley 41 may be disposed at the end of a crane on a ship.

The second pulley 42 may not be provided in another embodiment and pulleys may be additionally used in another embodiment.

The tensiometer 51 measures tension in the rope 30 between the first pulley 41 and the second pulley 42. The tension of the rope 30 changes with whether the driving unit 20 operates and with the position of the coring part 10. For example, the tension is smaller when the coring part 10 is supported by buoyancy in water than when it is on water.

The tensiometer 51 is connected with the rope 30 through a tension pulley 43 in order not to interfere with movement of the rope 30. A connector 52 is disposed between the tensiometer 51 and the tension pulley 43. One end of the connector 52 is coupled to the tension pulley 43 and the other end is thread-fastened to the tensiometer 51. The tensiometer 51 is held by a structure on a ship through a sub-rope 31. A connector 53 is also disposed between the tensiometer 51 and the sub-rope 31.

Figure 3:
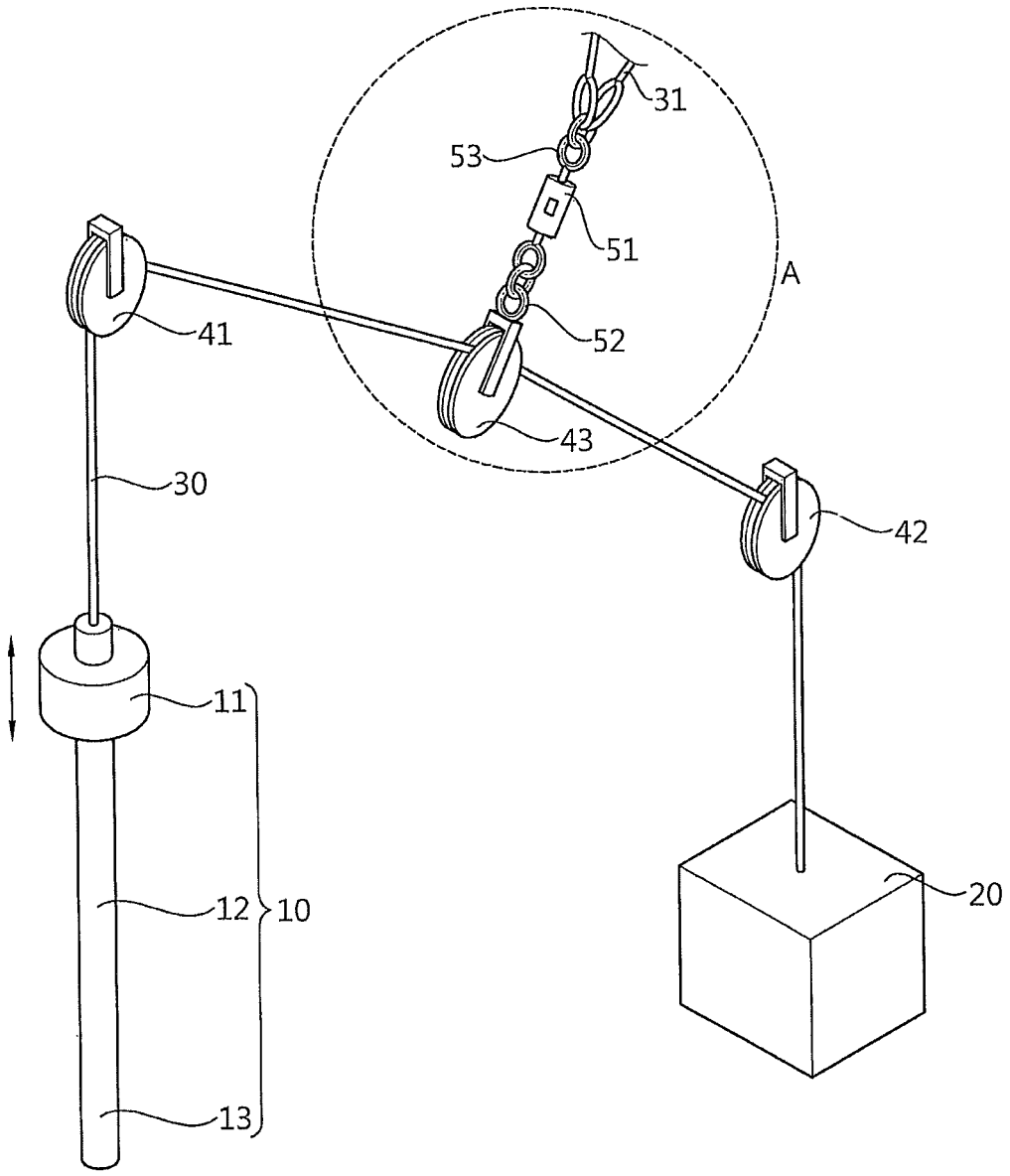
FIG. 3 is a view showing a coring system according to an embodiment of the present invention.

The tensiometer 51 can resist the tension range of the rope 30, and any kind of tensiometer can be used as long as it can be connected with the tension pulley 43 and the sub-rope 31, as in FIG. 3.

The data of tension measured by the tensiometer 51 is transmitted to a display unit 61 and a determining unit 62 by wire or wireless communication. The display unit 61 displays changes in tension, as coring proceeds (time passes), for the convenience of a user. Though not shown, a storing unit for storing the tension data may be provided.

The determining unit 62 determines whether coring was accurately performed on the basis of the data of measured tension. In detail, it can determine accurate coring on the basis of the magnitude of tension when the coring part 10 in the bottom of the sea is returned (pulled out from the bottom of the sea) or by comparing tension in other states.

When the tension in returning is a predetermined value or more in absolute value, it determines that accurate coring was achieved.

In determining by comparing, the tension A in returning may be compared with the tension B when the coring part 10 is above the sea or the tension B when the coring part 10 is in the sea. For example, when the tension A is large by a predetermined value (for example 200 kg, 500 kg etc.) than the tension B or is several times (for example, two times, five times, ten times etc.) the tension B or more, it determines that accurate coring was achieved. It can be determined in the same way, when the tension A is compared with the tension C.

The details of the predetermined value, predetermined level, or several times, which is the reference for the determination may be adjusted in accordance with the weight of the coring part 10.

The reason that it is possible to determine whether accurate coring was achieved, from the absolute value of the tension A in returning or by comparing the tension A with another tension is as follows.

Figure 1:
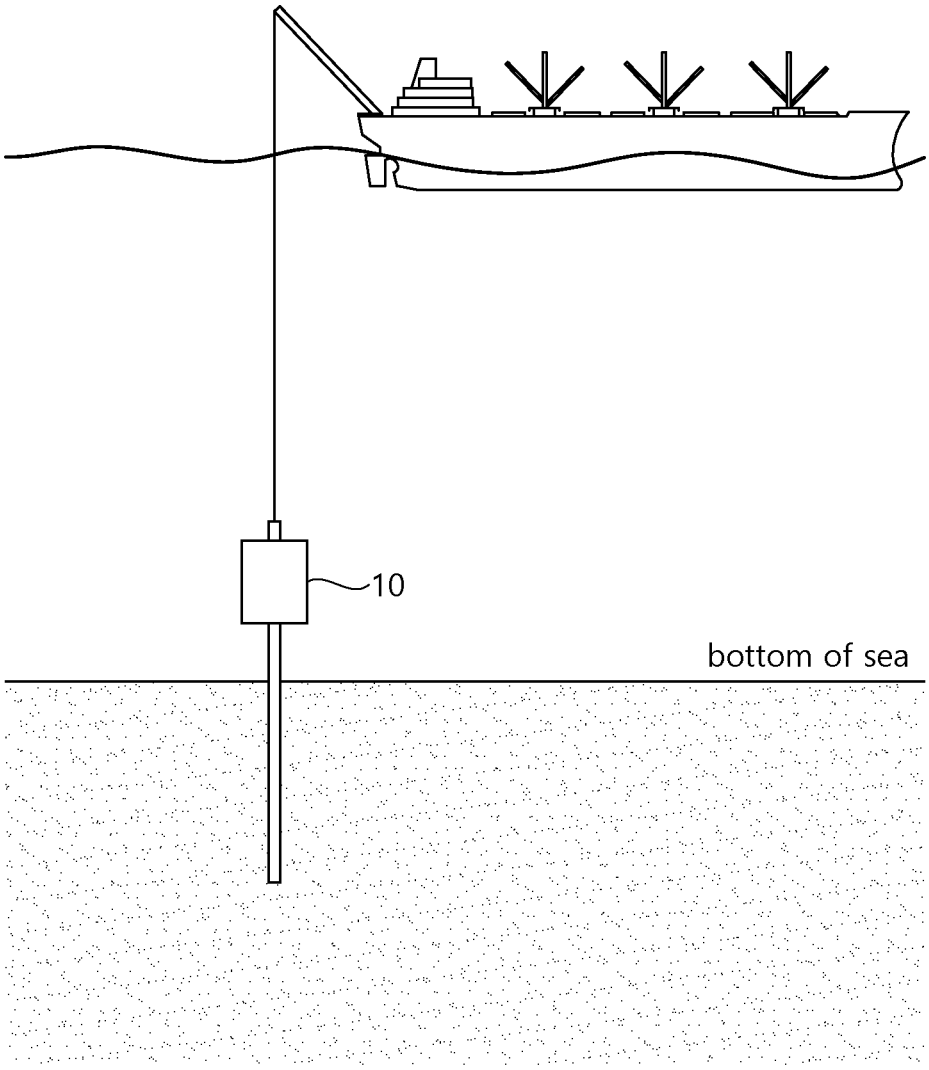
FIG. 1 Prior Art
FIG. 1 is a view showing a case when coring is accurately performed.
Figure 2:
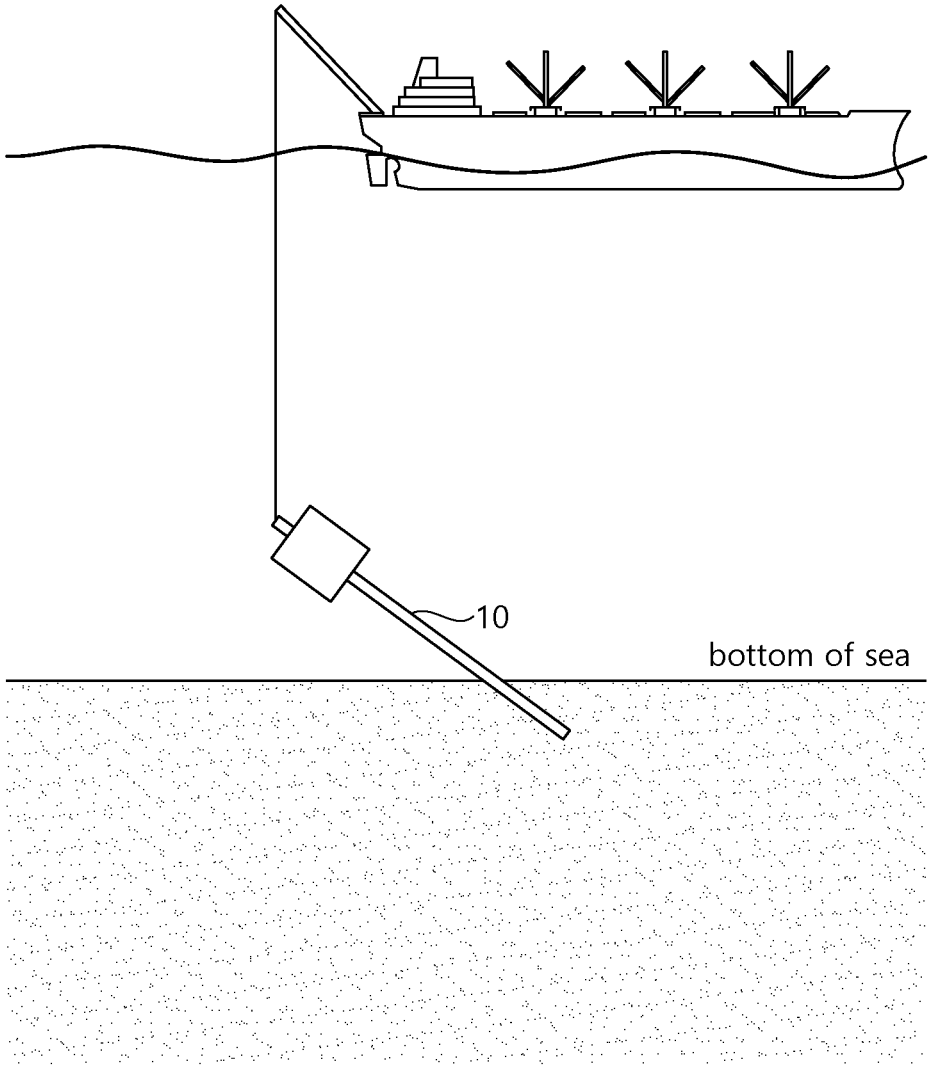
FIG. 2 Prior Art
FIG. 2 is a view showing a case when coring is inaccurately performed.

The largest tension is exerted in the rope 62, when the driving unit 20 is operated to return the coring part 10 in the bottom of the sea in coring. However, the force for returning is dispersed, when coring is performed wrong, as in FIG. 2. Accordingly, the tension for returning in FIG. 2 is smaller than that when coring is accurately performed, as in FIG. 1. Therefore, it is possible to determine whether coring was accurately performed, by observing the tension before/after returning.

Figure 6:
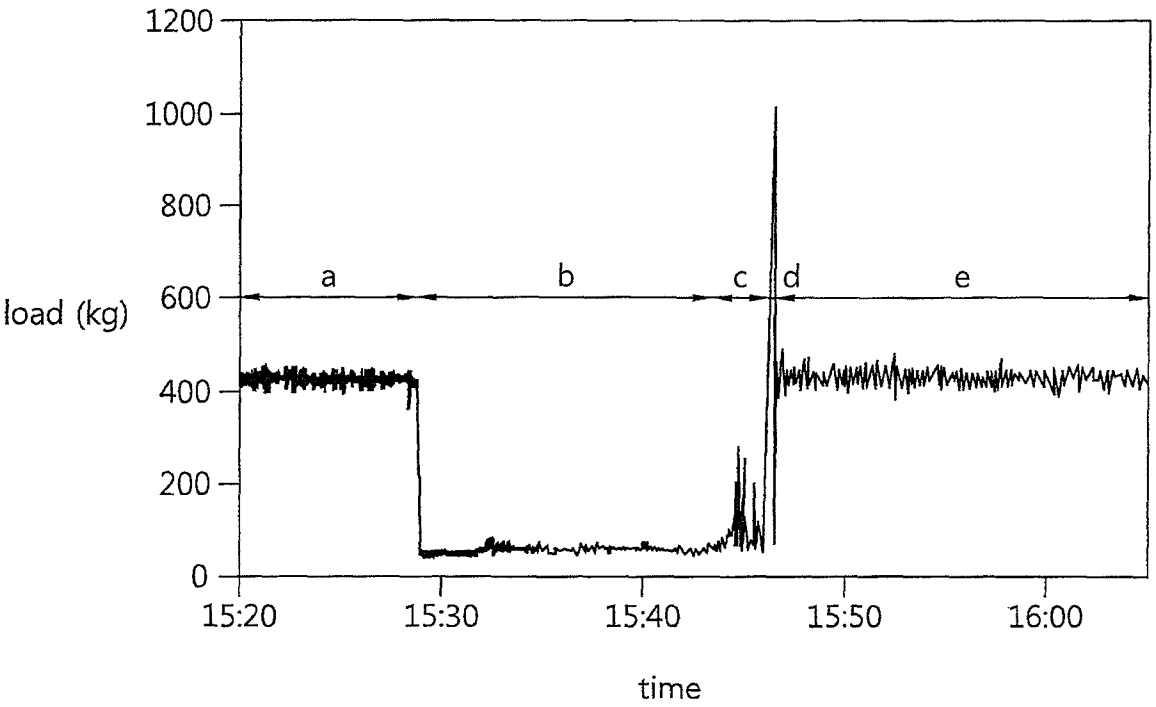
FIG. 6 is a view showing an example using the tensiometer according to an embodiment of the present invention.
Figure 7:
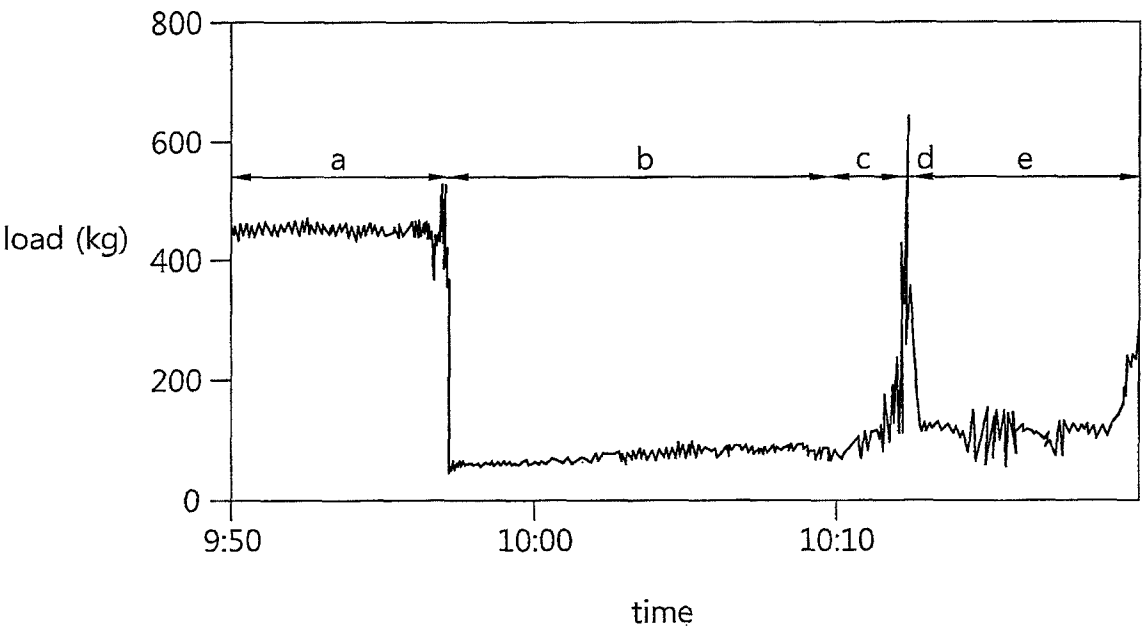
FIG. 7 is a view showing another example using the tensiometer according to an embodiment of the present invention.

A method of determining whether accurate coring was performed, using a change in tension is described hereafter with reference to FIGS. 6 and 7. FIG. 6 shows test data when accurate coring was achieved, as in FIG. 1, and FIG. 7 shows test data when coring was performed wrong, as in FIG. 2.

The section (a) is a period with the coring part 10 is in the sea, which tension of about 400 kg is maintained. The section (b) is a period when the coring part 10 is inserted in the bottom of the sea by its own weight, in which low level of tension is shown. A sediment comes into the coring core 13 in the section (b).

The section (c) is a period when the coring part 10 is moved up by the driving unit 20 winding the rope 30 after sampling of the sediment, in which the tension repeats increasing and decreasing. In the section (c), the tension when the coring part 10 is returned (pulled out) by the driving unit 20 that keeps winding the rope 30 is shown. The largest tension was over 100 kg. The tension in the section (d) is the largest in both of accurate coring and inaccurate coring.

Thereafter, in the section (e), the coring part 10 is in the sea. Though not shown, the coring part 10 is thereafter lifted out of the sea and a sample of the sediment is obtained.

When accurate coring is achieved, as in FIG. 6, the tension is the largest in the section (d) where the coring part 10 is pulled out, and is over two times the tension in the section (a) where the coring part 10 is in the sea. Further, changes in tension are distinct in the section (d) and the tension in the section (e) is similar to that in the section (a).

When accurate coring is achieved and the change pattern in tension of FIG. 6 is shown, it is possible to determine that it is accurate coring from whether the tension in the section (d) is over two times the tension of the section (a).

In contrast, when coring is performed wrong, as in FIG. 7, the tension when the coring part 10 is pulled out is not clear in comparison to that in FIG. 6 and the tension value is under two times that in the section (a). In FIG. 7, it would be considered that the coring part 10 was pulled out of the sediment in the middle of coring.

As described above, according to the present invention, it is possible to determine whether coring was accurately performed, by measuring tension.

The embodiments described above are examples for describing the present invention and the present invention is not limited thereto. The present invention may be achieved in various ways by those skilled in the art and the scope of the present invention should be determined by claims.

What is claimed is:

1. A coring system comprising:

a coring part with a core to be filled with an object to be cored;

a driving unit controlling upward/downward movement of the coring part;

a rope connecting the coring part with the driving unit;

a tensiometer measuring tension in the rope, and a determining unit that determines whether accurate coring was achieved by the coring part on the basis of a measurement result by the tensiometer.

2. The coring system of claim 1, wherein the determining unit determines that accurate coring was achieved when tension as the coring part is pulled out from the bottom of a sea or a river is greater than or equal to a predetermined value.

3. The coring system of claim 1, wherein the determining unit determines whether accurate coring was achieved by comparing the tension as the coring part is pulled out from the bottom of a sea or a river with the tension before/after the returning.

4. The coring system of claim 3, wherein the determining unit determines that accurate coring was achieved when the tension as the coring part is pulled out from the bottom of the sea or the river is larger by a predetermined level than the tension before/after the returning.

5. The coring system of claim 1, further comprising a display unit that displays the measurement value by the tensiometer.

6. The coring system of claim 1, further comprising coring pulleys disposed between the driving unit and the coring part and changing the arrangement direction of the rope to be vertical, wherein the tensiometer measures tension in the rope, between the coring pulleys and the driving unit.

7. The coring system of claim 6, further comprising a tension pulley between the tensiometer and the rope.

8. A method that determines whether accurate coring was achieved in a coring system including: a coring part with a core to be filled with an object to be cored; a driving unit controlling upward/downward movement of the coring part; and a rope connecting the coring part with the driving unit, the method comprising the steps of:

measuring tension in the rope in coring; and determining whether coring was accurately performed by the coring part on the basis of the measurement result by the tensiometer, wherein the determining step includes comparing the tension as the coring part is pulled out from the bottom of a sea or a river with the tension before/after coring.

9. The method of claim 8, wherein the determining further includes determining that accurate coring was achieved when the tension as the coring part is pulled out from the bottom of the sea or the river is larger by a predetermined level than the tension before/after coring.

10. The method of claim 8, wherein the coring system further includes coring pulleys disposed between the driving unit and the coring part for changing the arrangement direction of the rope to be vertical, and the measuring step is to measure tension in the rope between the coring pulleys and the driving unit.

* * * * *